US005875902A

United States Patent [19]

Emery et al.

[11] Patent Number: 5,875,902

[45] Date of Patent: Mar. 2, 1999

[54] LOCKING MEANS FOR OVER-THE-DOOR SHELF

[75] Inventors: William W. Emery, Berkeley Heights; Russell A. Fritts, Warren, both of N.J.

[73] Assignee: Better Sleep Mfg., Co., Berkeley Heights, N.J.

[21] Appl. No.: 984,286

[22] Filed: Dec. 3, 1997

[51] Int. Cl.[6] ..... A47F 5/00

[52] U.S. Cl. ..... 211/90.03; 211/106; 211/119; 211/88.01; 211/123; 211/119.004; 108/29

[58] Field of Search ..... 211/85.31, 88.01, 211/119, 119.004, 106, 113, 118, 90.03, 105.1, 123; 108/29, 30, 31

[56] References Cited

U.S. PATENT DOCUMENTS

| | | | |
|---|---|---|---|
| D. 354,412 | 1/1995 | Emery . | |
| D. 365,239 | 12/1995 | Emery et al. . | |
| 3,181,702 | 5/1965 | Raphael | 211/119 |
| 3,223,162 | 12/1965 | Hussey | 211/119 |
| 4,846,430 | 7/1989 | Ke . | |
| 5,405,026 | 4/1995 | Lee et al. | 211/106 X |
| 5,460,279 | 10/1995 | Emery et al. . | |
| 5,531,416 | 7/1996 | Remmers | 211/105.1 X |
| 5,588,543 | 12/1996 | Finger | 211/119 X |
| 5,758,851 | 6/1998 | Remmers | 211/105.1 X |
| 5,788,093 | 8/1998 | Krut | 211/119 |

*Primary Examiner*—Robert W. Gibson, Jr.
*Attorney, Agent, or Firm*—Hopgood, Calimafde Kalil & Judlowe

[57] ABSTRACT

This invention is directed to a multipurpose, over-the-door shelf organizer. It is characterized by a unique, yet simple locking mechanism to form a stable frame with superior structural integrity. The device is easily assembled for end use application; and easily collapsed to facilitate storage and shipment.

16 Claims, 7 Drawing Sheets

LOCKING MEANS FOR OVER-THE-DOOR SHELF

FIELD OF THE INVENTION

The present invention relates to over-the-door caddy organizers. More particularly, the invention is directed to a locking means for an over-the-door shelf organizer which allows collapsible transportation and subsequent assembly by an end-user.

BACKGROUND OF THE INVENTION

Household organizers which take advantage of existing structures and open, unused spaces are known in the art. For example, Ke Patent No. 4,846,430 discloses a door organizer which can be used to suspend garments, towels and the like. While maximizing the use of existing structures and unused space is convenient for end-users, manufacturers prefer compact organizers for easy shipping and reduced freight rates. Non-collapsible, single-piece units are costly to transport. They are also difficult to handle, store and display in retail space. It is therefore desirable to produce "knocked down" or multi-piece, collapsible versions of organizers.

Shelf or rack organizers specifically for suspending from the top aspects of a door are also known. Most currently known over-the-door organizers are unitary structures having a frame and shelves formed from coated steel wire. These single piece units are difficult to handle because their overall configurations do not conform well to conventional commercial packaging. They also require excessive storage space to accommodate their various shapes and sizes.

Attempts have been made to produce knocked down or collapsible over-the-door organizers. Generally, coated steel wire shelves are supported by vertical, metal tubing frame members which have mounting holes disposed in their sides to accept the coated wire. The ends are then capped with formed metal nuts. These joints are cheap and easy to manufacture, but they are unstable and the resulting assembly has poor structural integrity. This instability may cause physical distortion, especially when the door is swinging about its hinges.

Commercially successful over-the-door shelf organizers are disclosed in Emery Patent No. 5,460,279. Other configurations are illustrated in Design Pat. Nos. 354,412 and 365,239. But, the prior art designs do not provide an improved locking means which permits collapsible transportation, storage and assembly by the end-user.

OBJECTS OF THE INVENTION

It is an object of the present invention to provide a shelf organizer which is collapsible for cost-effective shipping, storage and display.

Another object of the present invention is to provide a collapsible shelf organizer with a novel locking means which delivers superior structural integrity.

Yet another object of the present invention is to provide a collapsible, over-the-door shelf organizer having structural elements which comprise a unique locking means for ease of assembly.

These and other objects will be apparent from the present disclosure.

SUMMARY OF THE INVENTION

The invention is a collapsible shelf organizer adapted for attachment to structures such as doors and the like. It comprises at least two vertically extending frame members each having at least one basket support element equipped with a retainer and terminal loop structure. The retainer of the basket support element can be a ball or sphere.

The shelf organizer further comprises at least one basket disposed between the vertically extending frame members. Each basket has an upper surface, lower surface and means for locking with the retainer and terminal loop structure of each basket support element. The shelf organizer further comprises a hanger bar having another means for locking with the upper and lower surfaces of the basket.

Each of the basket support elements operably connects to its vertically extending frame member so that the terminal loop structure of the basket support element is disposed along an axis extending substantially perpendicular to its specific vertically extending frame member.

The means for locking with the retainer and terminal loop structure of a basket support element comprises a grip lock and loop lock. The grip lock is adapted for engagement with the retainer and the loop lock is adapted for engagement with the loop structure on the basket support element.

The basket is further comprised of a rear portion and mid portion, with the upper and lower surfaces of the basket being disposed on the rear portion, and the mid portion further comprising a superior surface and dorsal surface. The upper and lower surfaces of the basket are adapted to engage the hanger bar. The means for locking the hanger bar to the basket comprises a gravity lock and a flange lock. The gravity lock further comprises a semi-circular piece and clasp portion, while the flange lock further comprises a semi-circular portion and lateral tip.

The semi-circular piece of the gravity lock is adapted for engagement with the dorsal surface of the mid portion of the basket, and the clasp portion of the gravity lock is adapted for engagement with the upper surface of the rear portion of the basket. The semi-circular portion of the flange lock is adapted for engagement with the superior surface of the mid portion of the basket, and the lateral tip of the flange lock is adapted for engagement with the lower surface of the rear portion of the basket.

BRIEF DESCRIPTION OF THE DRAWINGS

For a more complete understanding of this invention, reference is made to the following detailed description in connection with the accompanying drawings.

DETAILED DESCRIPTION OF THE INVENTION

Figure 1:
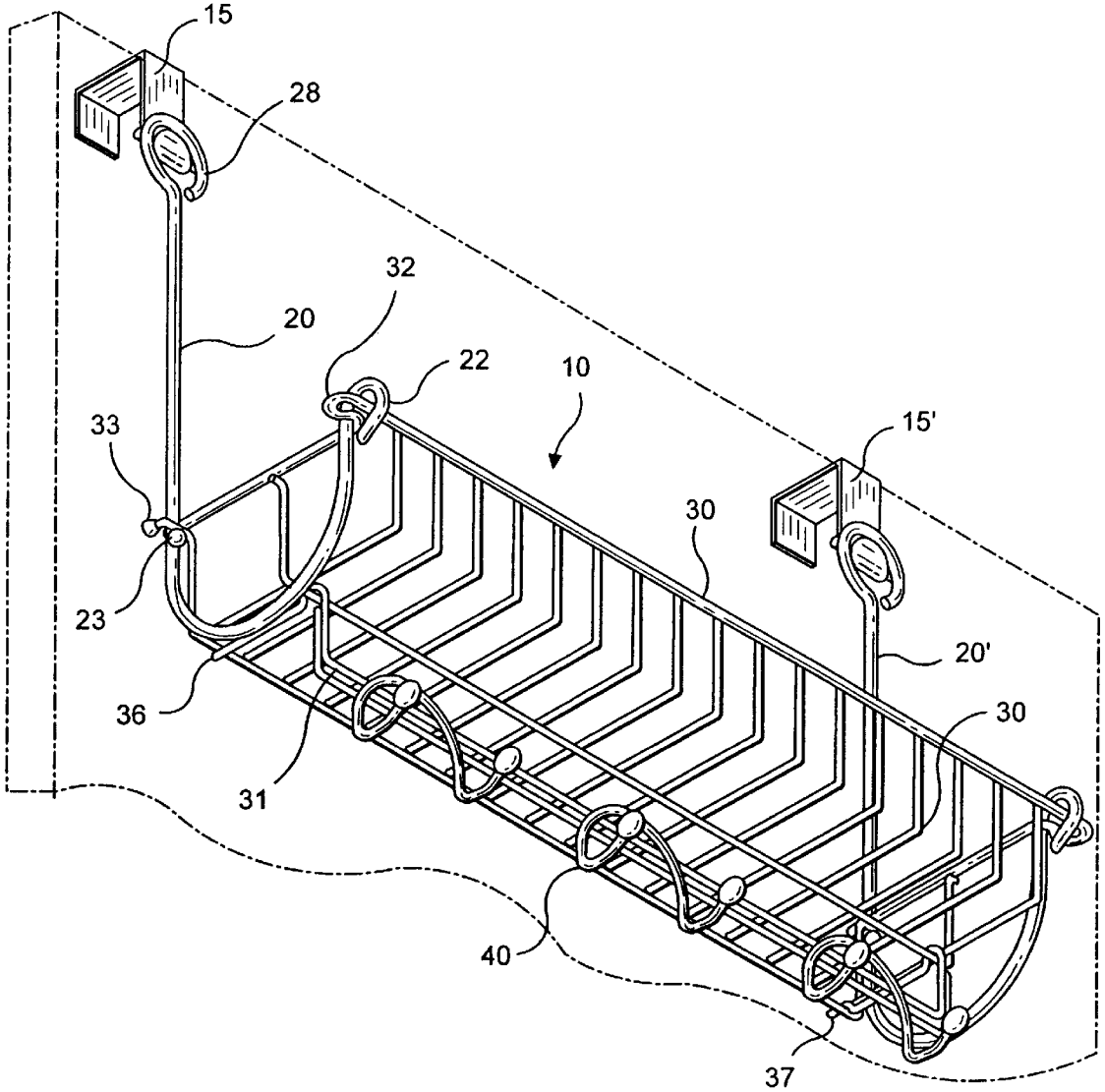
FIG. 1 is a lower perspective view of the collapsible shelf organizer showing the preferred embodiment of the present invention with a portion of a door from which it suspends represented by phantom lines.

FIG. 1 illustrates the preferred embodiment of the present invention showing an assembled shelf organizer generally designated 10. The preferred embodiment is constructed principally of coated steel wire, but one skilled in the art can readily appreciate a variety of other possible materials suitable for this construction.

Figure 2:
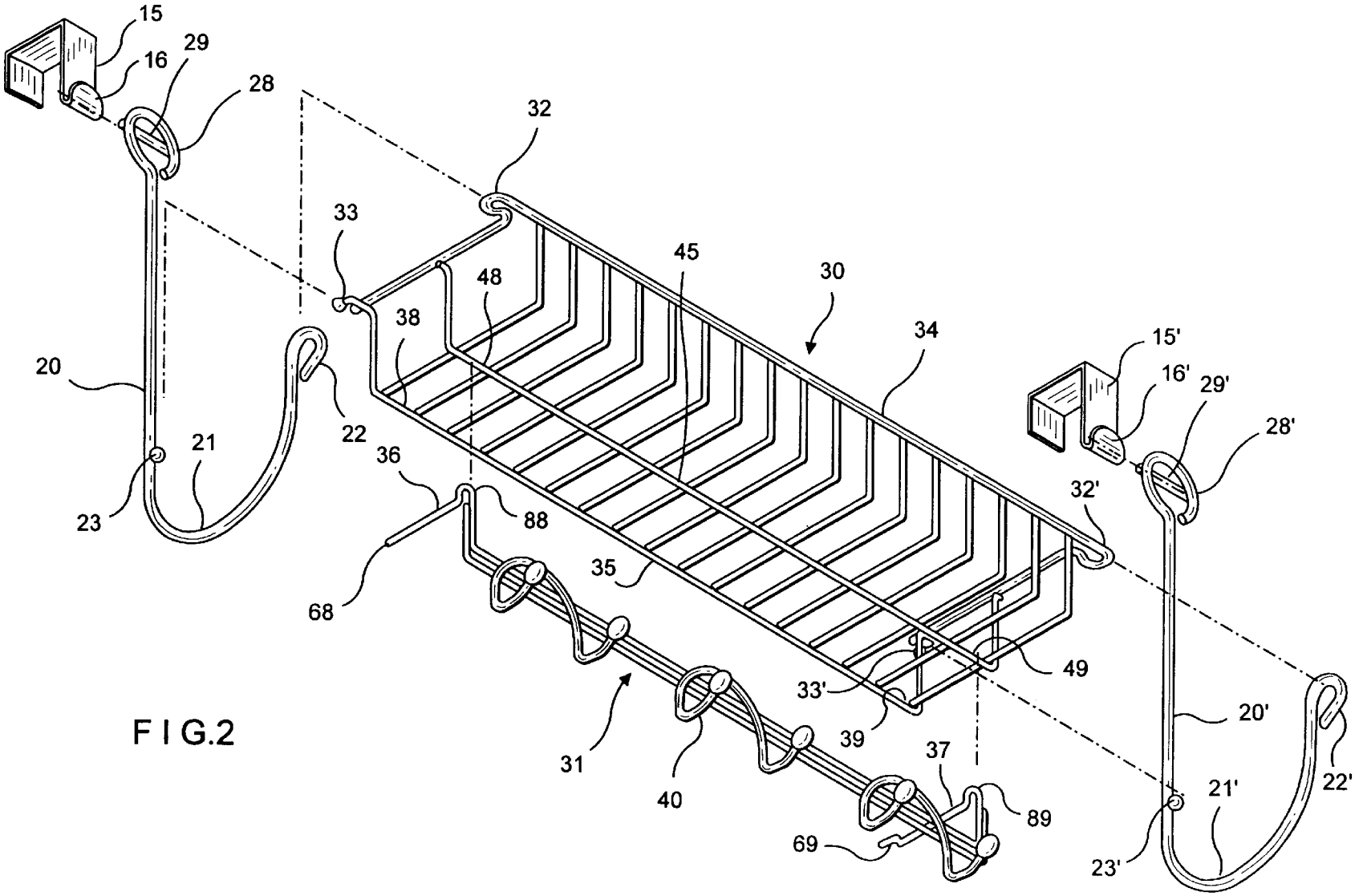
FIG. 2 is an exploded view of the individual components which constitute the preferred embodiment of the present invention.

FIG. 2 shows that shelf organizer 10 comprises two vertically extending frame members 20 and 20', basket 30 and hanger bar 31. Vertical frame member 20, taken as representative, has circular member 28 at its uppermost portion. Circular member 28 has in its diameter cross wire 29 for attachment to semi-circular end 16 of hanger bracket 15.

Extending from vertical frame member 20 is basket support element 21. In the preferred embodiment shown in FIG. 2, support element 21 has a semi-circular shape with an upwardly facing concavity. Other design variations are possible depending on the aesthetic qualities preferred, and all variations are within the scope and spirit of this disclosure. Support element 21 extends orthogonally to the plane of frame member 20 and terminates in substantially closed loop structure 22 which extends from basket support element 21.

Basket 30 is comprised of front portion 34, mid portion 45 and rear portion 35. At each of its two ends, front portion 34 has loop locks 32 and 32' which are adapted for passage through, and releasable engagement with, the apertures formed in loop structures 22 and 22'. Mid portion 45 is shown in FIG. 2 with superior surface 48 and dorsal surface 49. Rear portion 35 has at each of its two ends grip locks 33 and 33'. These locks are adapted for releasable engagement with frame members 20 and 20' at ball retainers 23 and 23'.

Intermediate to grip lock 33 on rear portion 35 is lower surface 38. Lower surface 38 (on rear portion 35) and superior surface 48 (on mid portion 45) cooperate to form a flange lock which is further described below. Intermediate to grip lock 33' on rear portion 35 is upper surface 39. Upper surface 39 (on rear portion 35) and dorsal surface 49 (on mid portion 45) cooperate to form a gravity lock which is also described below.

Hanger bar 31 has at each of its two ends flange lock 36 and gravity lock 37, respectively. Flange lock 36 is comprised of semi-circular portion 88 which straightens and terminates at lateral tip 68. Gravity lock 37 is comprised of semi-circular piece 89 which straightens and terminates at clasp portion 69. Semi-circular portion 88 and lateral tip 68 (of flange lock 36) are adapted for releasable engagement with superior surface 48 (on mid portion 45) and lower surface 38 (on rear portion 35). Semi-circular piece 89 and clasp portion 69 (of gravity lock 37) are adapted for releasable engagement with dorsal surface 49 (on mid portion 45) and upper surface 39 (on rear portion 35). Hanger bar 31 is shown in FIG. 2 with hooks 40 for hanging suitable items such as clothing and the like.

Figure 3:
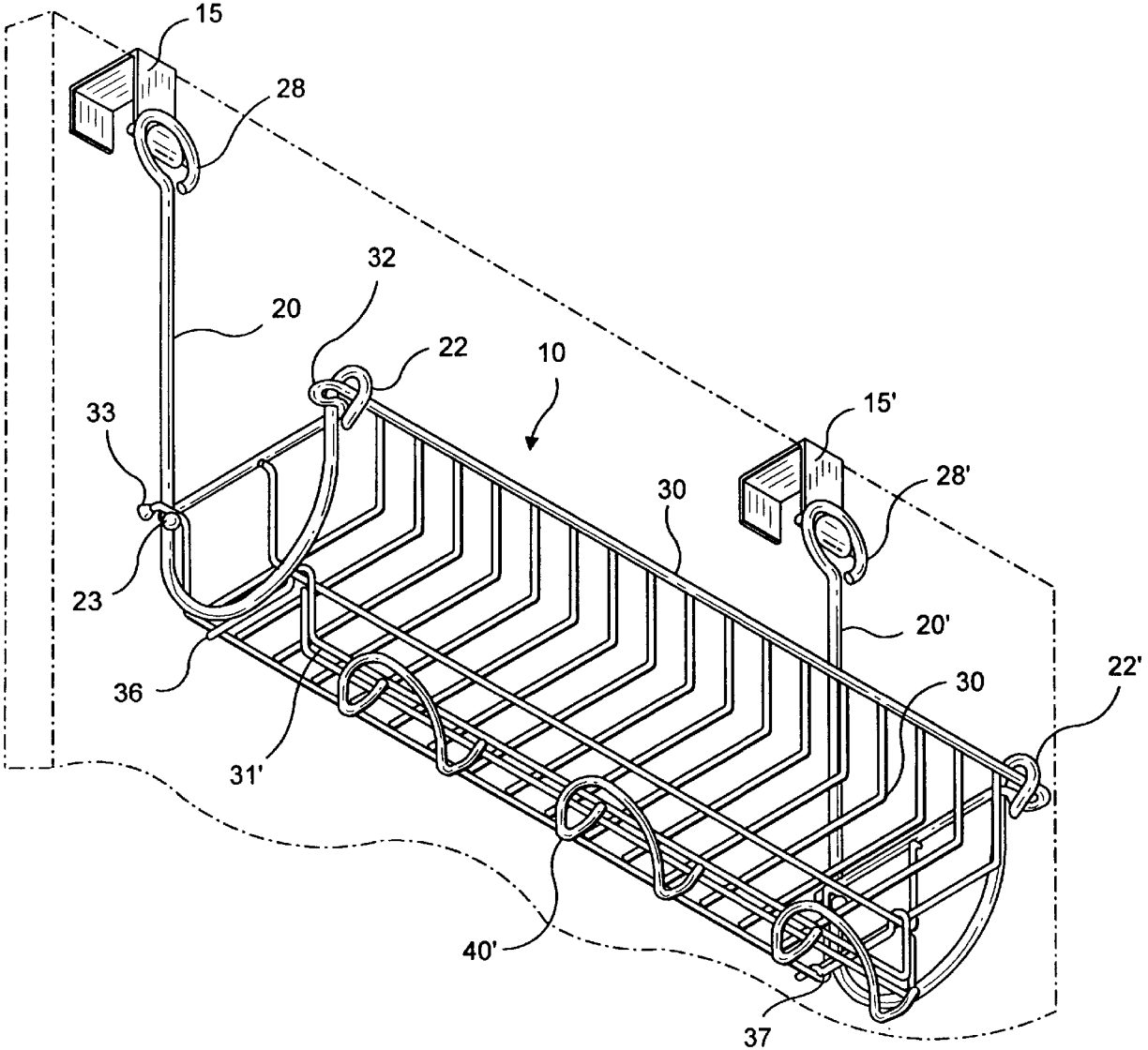
FIGS. 3 and 4 are lower perspective views of alternate design choices for the over-the-door shelf organizer.
Figure 4:
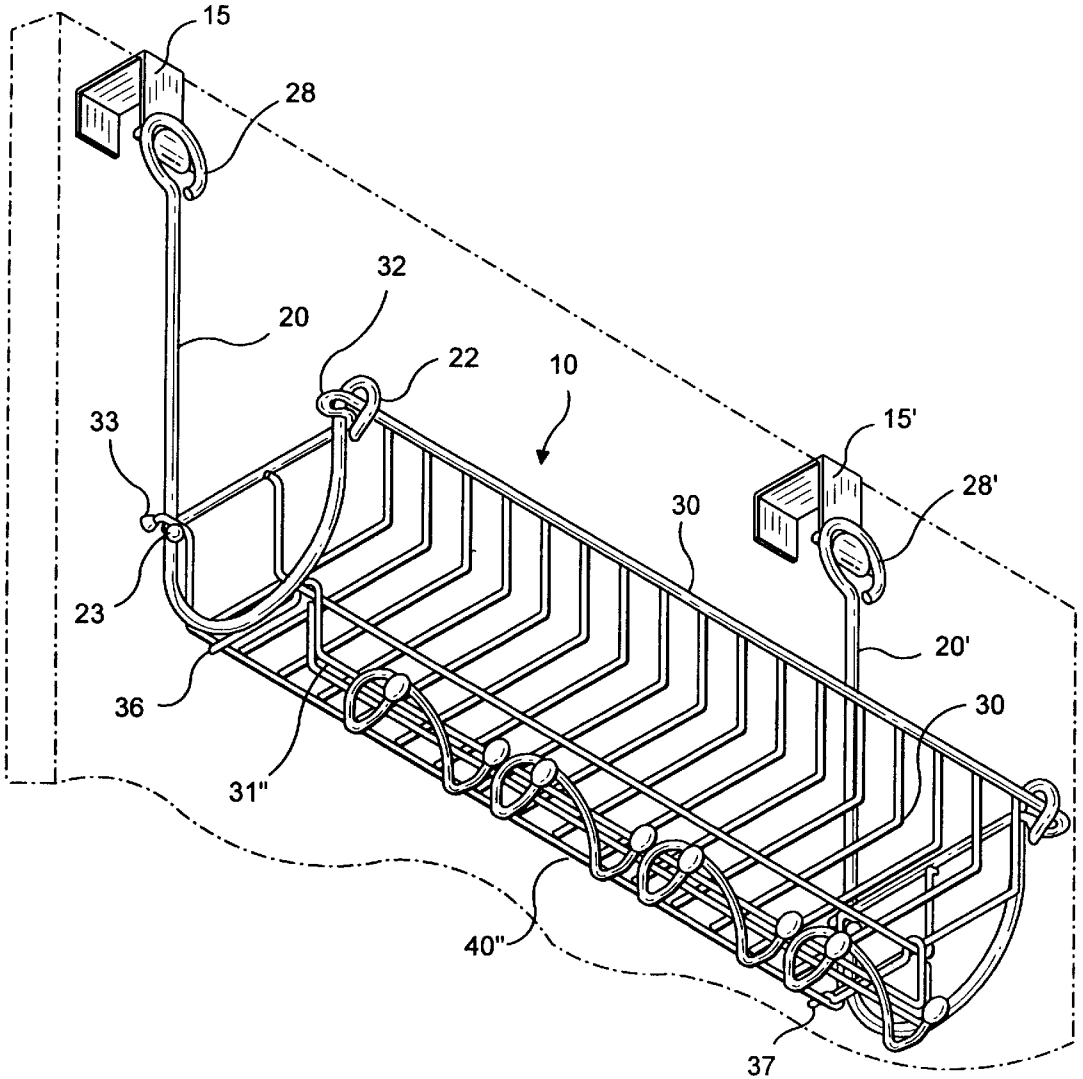

FIGS. 3 and 4 are lower perspective views of alternate style choices for the over-the-door shelf organizer and demonstrate that the number of hooks (40' or 40") and their design configurations are a matter of practical and aesthetic choice.

Figure 5:
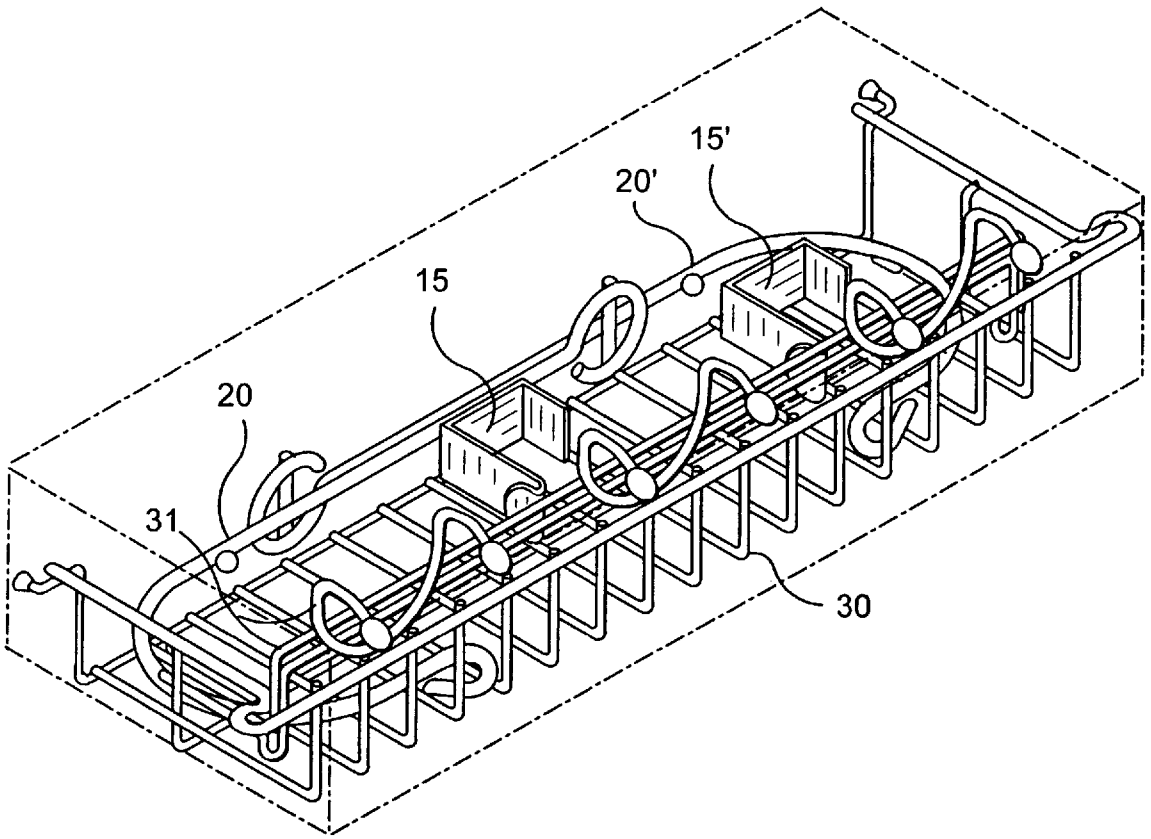
FIG. 5 shows the component pieces of the shelf organizer illustrated in FIGS. 1 and 2 in its collapsed state and neatly packed in a configuration suitable for cost-effective shipping, storage and display.

FIG. 5 illustrates the components of the preferred shelf organizer (shown exploded in FIG. 2) in its collapsed state and packed in an optimum configuration for efficient shipping and storage. The ability to knock down the component pieces avoids protrusions and allows the entire product to be shipped within a small and confined package represented by phantom lines.

Figure 6A:
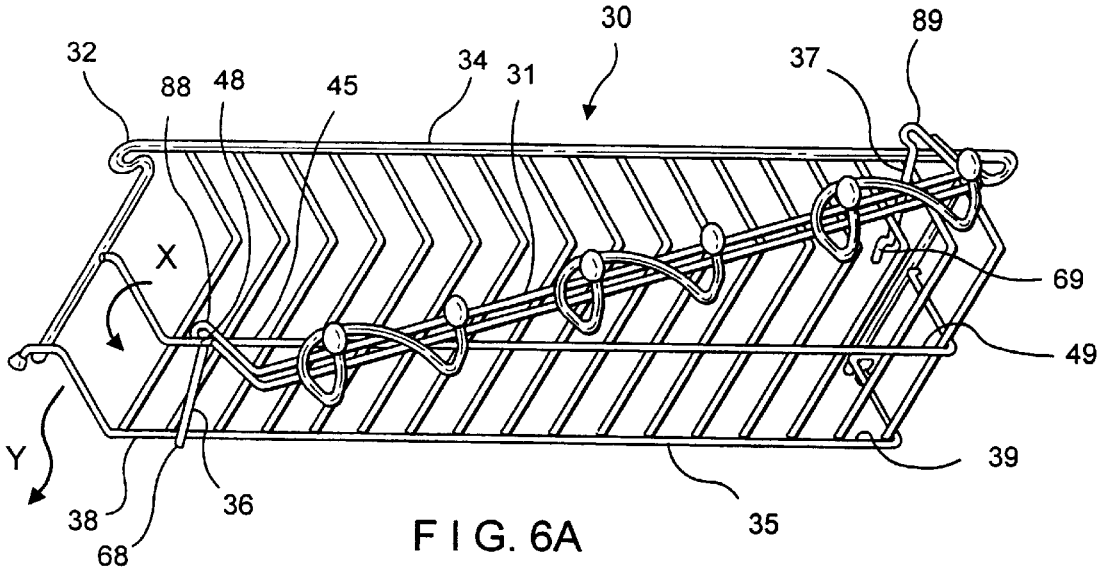
FIGS. 6A through 6C are a series of drawings showing one aspect of the locking means of the present invention.
Figure 6B:
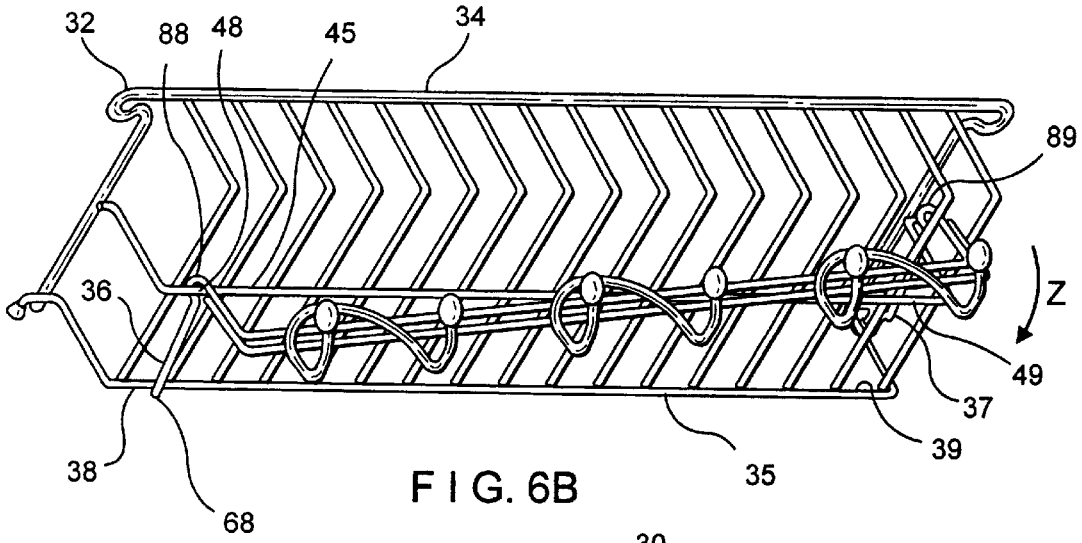
Figure 6C:
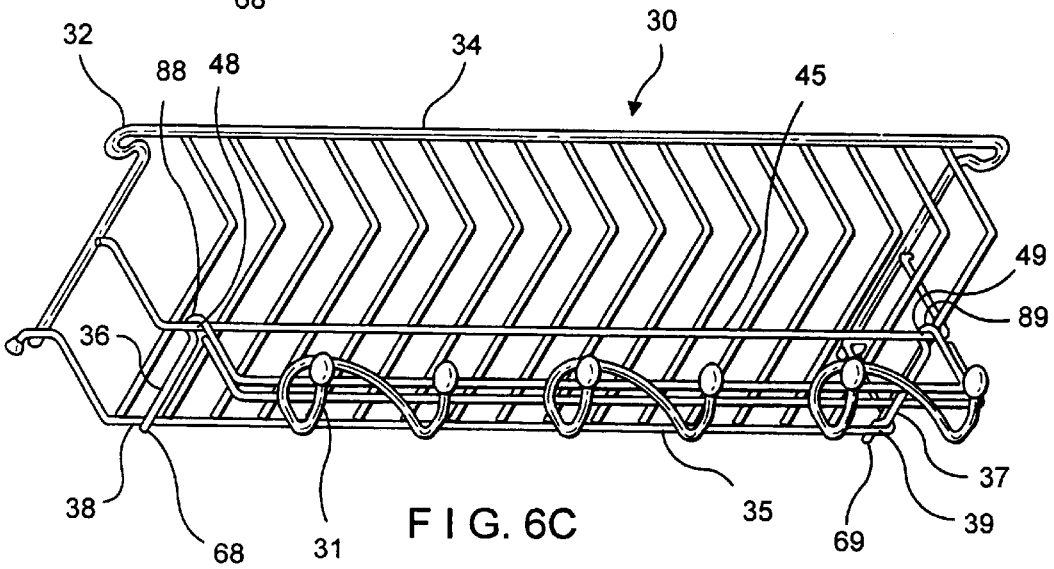

FIGS. 6A, 6B and 6C sequentially show how hanger bar 31 is mounted to basket 30 during assembly. FIG. 6A shows the initial placement of semi-circular portion 88 of flange lock 36 over superior surface 48 on mid portion 45, following the pathway designated with arrow X. Lateral tip 68 of flange lock 36 is then placed under lower surface 38 on rear portion 35, following the pathway designated with arrow Y.

FIG. 6B shows that semi-circular piece 89 of gravity lock 37 is next placed above dorsal surface 49 on mid portion 45 and allowed to descend following the pathway designated with arrow Z. Lateral tip 68 of flange lock 36 snaps under rear portion 35 and engages lower surface 38 on rear portion 35. FIG. 6C shows that flange lock 36 is biased into position by the cooperation of semi-circular portion 88 engaged to superior surface 48 of mid portion 45 and by lateral tip 68 engaged to lower surface 38 of rear portion 35. The descending weight of basket 30 snaps semi-circular piece 89 of gravity lock 37 onto dorsal surface 49 on mid portion 45, and simultaneously snaps clasp portion 69 of gravity lock 37 onto upper surface 39 on rear portion 35, which completes the attachment of hanger bar 31 to basket 30.

Figure 7A:
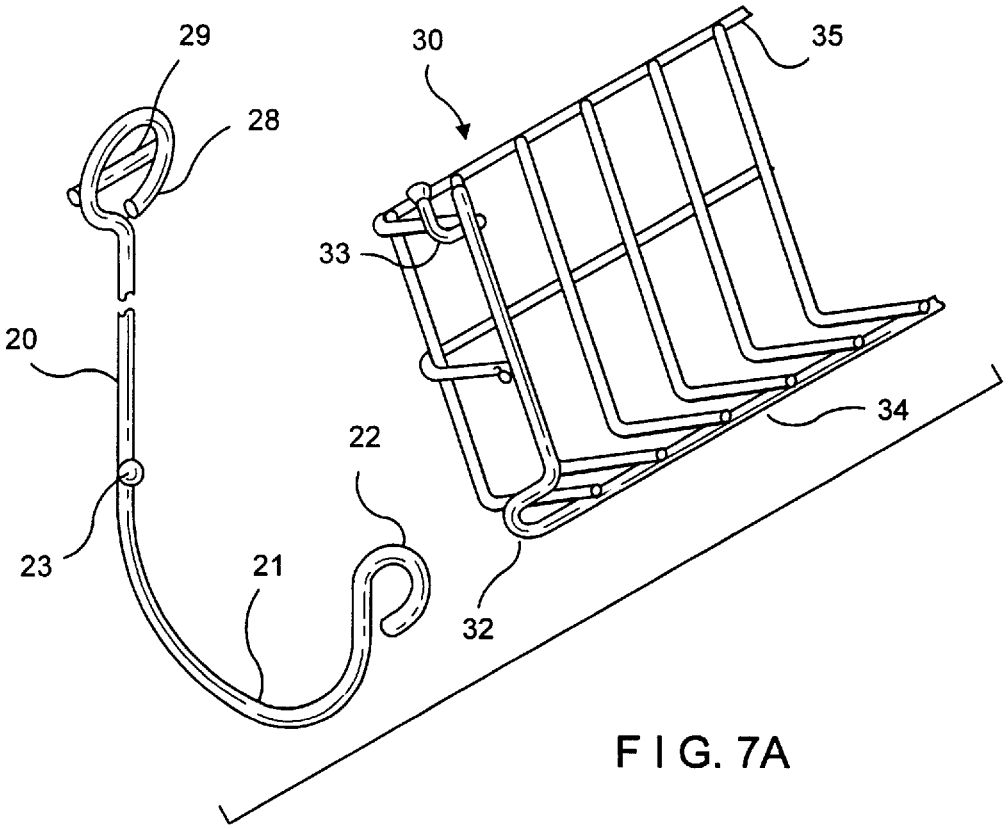
FIGS. 7A and 7B are isolated, cut-away views of another aspect of the locking mechanism of the present invention.
Figure 7B:
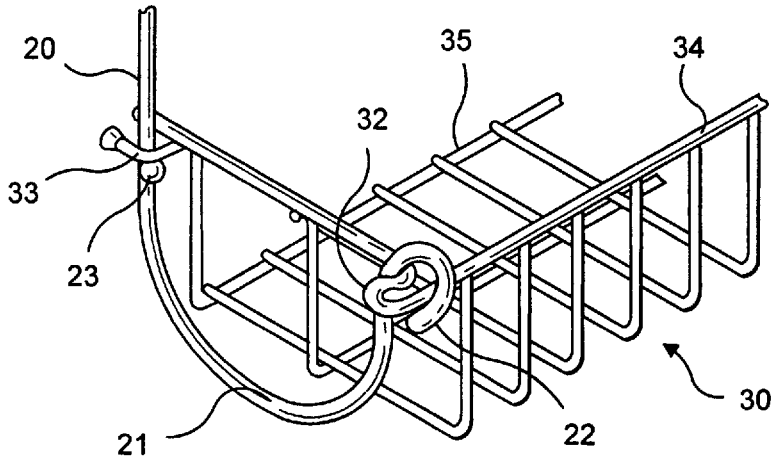

FIGS. 7A and 7B are isolated, cut-away views of another aspect of the locking mechanism of the preferred embodiment. FIG. 7A shows that basket 30 has loop lock 32 extending laterally from front portion 34. Loop lock 32 is adapted to fit through the aperture formed by closed loop structure 22 of basket support element 21. Forked grip lock 33 is adapted for slidable engagement with frame member 20 and comes to rest on ball retainer 23 to complete the lock as shown in FIG. 7B.

In overview, to assemble shelf organizer 10, hanger brackets 15 and 15' (see FIG. 1) are placed over the top of a suitable structure such as a door. Referring to FIGS. 1 and 2, cross wires 29 and 29' on the upper portions of vertical frame members 20 and 20' are slipped into semi-circular ends 16 and 16' of hanger brackets 15 and 15'. After spacing and centering suspended vertical frame members 20 and 20', basket 30 is placed between them and tipped forward so that rear portion 35 of basket 30 points in an upward direction as shown in FIG. 7A. Loop lock 32 is inserted through loop structure 22 of frame member 20. This is repeated on the opposite end of basket 30, with loop lock 32' inserted through loop structure 22' of frame member 20' (not shown).

Once loop locks 32 and 32' are in position, rear portion 35 of basket 30 is allowed to descend in a counter clockwise direction until grip lock 33 rests firmly on ball retainer 23 as shown in FIG. 7B. This action is simultaneously conducted on the opposite end of basket 30, with loop locks 32 and 32' rotating within loop structures 22 and 22' until grip lock 33' is firmly anchored on ball retainer 23' (not shown). Hanger 31 can be locked into basket 30 before or after vertical support frame members 20 and 20' are locked with basket 30.

Further modifications based on this disclosure will occur to persons skilled in the art. These modifications are within the scope and spirit of the present invention as defined by the following claims.

What is claimed is:

1. A collapsible shelf organizer for attachment to structures such as doors, said organizer comprising:

at least two vertically extending frame members each having at least one basket support element extending therefrom, said support element having a retainer and a terminal loop structure;

at least one basket disposed between said vertically extending frame members, said basket having an upper surface, a lower surface and a first means for locking with said retainer and said terminal loop structure of said support element; and a hanger bar having a second means for locking with said upper surface and said lower surface of said basket.

2. The organizer of claim 1, wherein each of said basket support elements operably connects to its vertically extending frame member such that said terminal loop structure of said basket support element is disposed along an axis extending substantially perpendicular to said vertically extending frame member.

3. The organizer of claim 1, wherein said retainer of said basket support element is a ball retainer.

4. The organizer of claim 3, wherein said first means for locking comprises a grip lock and a loop lock, said grip lock adapted for engagement with said ball retainer and said loop lock adapted for engagement with said loop structure of said support element.

5. The organizer of claim 1, wherein said second means for locking comprises a gravity lock and a flange lock, and wherein said gravity lock is adapted for engagement with said upper surface of said basket and said flange lock is adapted for engagement with said lower surface of said basket.

6. The organizer of claim 5, wherein said basket is further comprised of a rear portion and a mid portion, said upper surface and said lower surface of said basket being disposed on said rear portion, and said mid portion further comprises a superior surface and a dorsal surface.

7. The organizer of claim 6, wherein said gravity lock comprises a semi-circular piece and a clasp portion, and said flange lock comprises a semi-circular portion and a lateral tip.

8. The organizer of claim 7, wherein said semi-circular piece of said gravity lock is adapted for engagement with said dorsal surface of said mid portion of said basket;

said clasp portion of said gravity lock is adapted for engagement with said upper surface of said rear portion of said basket;

said semi-circular portion of said flange lock is adapted for engagement with said superior surface of said mid portion of said basket; and said lateral tip of said flange lock is adapted for engagement with said lower surface of said rear portion of said basket.

9. A collapsible shelf organizer for over-the-top attachment to structures such as doors, said organizer comprising:

a first vertically extending frame member having a first basket support element extending therefrom, said first basket support element having a first retainer and a first terminal loop structure;

a second vertically extending frame member having a second basket support element extending therefrom, said second basket support element having a second retainer and a second terminal loop structure;

a basket disposed between said first and second vertically extending frame members, said basket having an upper surface, a lower surface, a first means for locking with said first retainer and said first terminal loop structure, and a second means for locking with said second retainer and said second terminal loop structure; and a hanger bar having a third means for locking with said upper surface and said lower surface of said basket.

10. The organizer of claim 9, wherein each of said basket support elements operably connects to its vertically extending frame member such that each said terminal loop structure of said basket support element is disposed along an axis extending substantially perpendicular to its corresponding vertically extending frame member.

11. The organizer of claim 9, wherein each said retainer of each said basket support element is a ball retainer.

12. The organizer of claim 9, wherein said first means for locking comprises a first grip lock and a first loop lock, said first grip lock adapted for engagement with said first retainer and said first loop lock adapted for engagement with said first loop structure of said first basket support element; and said second means for locking comprises a second grip lock and a second loop lock, said second grip lock adapted for engagement with said second retainer and said second loop lock adapted for engagement with said second loop structure of said second basket support element.

13. The organizer of claim 9, wherein said third means for locking comprises a gravity lock and a flange lock, and wherein said gravity lock is adapted for engagement with said upper surface of said basket and said flange lock is adapted for engagement with said lower surface of said basket.

14. The organizer of claim 13, wherein said basket is further comprised of a rear portion and a mid portion, said upper surface and said lower surface of said basket are disposed on said rear portion, and said mid portion further comprises a superior surface and a dorsal surface.

15. The organizer of claim 14, wherein said gravity lock comprises a semi-circular piece and a clasp portion, and said flange lock comprises a semi-circular portion and a lateral tip.

16. The organizer of claim 15, wherein said semi-circular piece of said gravity lock is adapted for engagement with said dorsal surface of said mid portion of said basket;

said clasp portion of said gravity lock is adapted for engagement with said upper surface of said rear portion of said basket;

said semi-circular portion of said flange lock is adapted for engagement with said superior surface of said mid portion of said basket; and said lateral tip of said flange lock is adapted for engagement with said lower surface of said rear portion of said basket.

* * * * *